US011292652B1

(12) United States Patent
Rojas

(10) Patent No.: US 11,292,652 B1
(45) Date of Patent: Apr. 5, 2022

(54) CONSUMABLES CONTAINER ASSEMBLY INCLUDING A COLLAPSIBLE, SEALING INTERNAL BAG

(71) Applicant: Enzo Rojas, Sunrise, FL (US)

(72) Inventor: Enzo Rojas, Sunrise, FL (US)

( * ) Notice: Subject to any disclaimer, the term of this patent is extended or adjusted under 35 U.S.C. 154(b) by 0 days.

(21) Appl. No.: 17/152,998

(22) Filed: Jan. 20, 2021

Related U.S. Application Data

(60) Provisional application No. 62/963,431, filed on Jan. 20, 2020.

(51) Int. Cl.
*B65D 81/20* (2006.01)

(52) U.S. Cl.
CPC ..... *B65D 81/2038* (2013.01)

(58) Field of Classification Search
CPC .... B65D 25/16; B65D 81/20; B65D 81/2007; B65D 81/2023; B65D 81/2038
USPC ..... 206/524.8; 220/361
See application file for complete search history.

(56) References Cited

U.S. PATENT DOCUMENTS 3,610,455 A 10/1971 Greenhalgh et al.
4,051,971 A 10/1977 Saleri et al.
4,143,785 A 3/1979 Ferrell
4,337,804 A 7/1982 Maruscak
4,466,553 A 8/1984 Zenger
4,925,055 A 5/1990 Robbins, III et al.
5,096,078 A * 3/1992 McQueeny ..... B65D 51/26 206/522
5,494,165 A * 2/1996 Detrick ..... B65D 81/2038 206/524.8
5,628,404 A * 5/1997 Hendrix ..... B65D 25/16 206/524.8
5,955,127 A 9/1999 Glaser
5,964,255 A 10/1999 Schmidt
6,035,769 A 3/2000 Nomura et al.
6,059,457 A 5/2000 Sprehe et al.
6,074,677 A 6/2000 Croft
6,206,220 B1 3/2001 Stodd
6,422,455 B1 7/2002 Cahill et al.
6,513,658 B1 * 2/2003 Adkins ..... B65D 81/052 206/522
6,799,680 B2 10/2004 Mak
7,093,710 B2 * 8/2006 Shimizu ..... B41J 2/17533 206/213.1
7,614,203 B2 11/2009 Oltrogge
7,931,052 B2 4/2011 Schooley
8,056,471 B2 11/2011 Wakabayashi
(Continued)

OTHER PUBLICATIONS

"FoodSaver® Fresh Containers" found at www.target.com.
"Zevro by Honey Can Do Vac 'n Save" found at www.walmart.com.

*Primary Examiner* — Luan K Bui
(74) *Attorney, Agent, or Firm* — John Rizvi; John Rizvi, P.A.—The Patent Professor®

(57) ABSTRACT

A consumables container assembly includes a container and an air-extracting device. The container has a one-way valve and a collapsible internal bag for containing consumables. The air-extracting device can be connected to the one-way valve and operated to evacuate air from the internal bag and collapse the internal bag onto the consumables to maintain the freshness of the consumables. The one-way valve may shut or prevent air passage upon removal of the air-extracting device from the one-way valve. The one-way valve can optionally be provided on a cap or container lid.

20 Claims, 13 Drawing Sheets

(56) References Cited

U.S. PATENT DOCUMENTS

| | | | | |
|---|---|---|---|---|
| 9,682,791 | B2 | 6/2017 | Lorence et al. | |
| 10,336,488 | B1 * | 7/2019 | Kjelson | B65B 31/048 |
| 2002/0124471 | A1 | 9/2002 | Anderson et al. | |
| 2003/0178429 | A1 | 9/2003 | Williams et al. | |
| 2003/0230201 | A1 | 12/2003 | Zhao | |
| 2006/0201576 | A1 | 9/2006 | Domenig | |
| 2010/0000995 | A1 * | 1/2010 | Yarbrough | A47L 9/182<br>220/212 |
| 2011/0091138 | A1 | 4/2011 | Wakabayashi | |
| 2018/0354701 | A1 * | 12/2018 | Avrech | B65D 81/2023 |

* cited by examiner

CONSUMABLES CONTAINER ASSEMBLY INCLUDING A COLLAPSIBLE, SEALING INTERNAL BAG

CROSS-REFERENCE TO RELATED APPLICATION

This application claims the benefit of U.S. Provisional Patent Application No. 62/963,431, filed on Jan. 20, 2020, which is incorporated herein by reference in its entirety.

FIELD OF THE INVENTION

The present invention relates generally to containers for containing and maintaining the freshness of consumables, and more particularly, to a consumables container assembly having a container including a collapsible, internal liner or bag for containing consumables and an air-extracting device which can be deployed to evacuate air from the internal bag to maintain the freshness of the consumables.

BACKGROUND OF THE INVENTION

A variety of containers have been developed for the storage and transport of fruits, vegetables, meats, beverages, and other consumables. For example, bottles typically have a relatively wide cylindrical body from which a narrowed or tapered shoulder extends. A threaded neck typically extends from the shoulder, and a cap is threaded on the neck. In packaging, a beverage is dispensed into the bottle and the cap threaded on the neck to maintain the freshness of the beverage during transport and retail storage. Upon purchase, a consumer removes the cap to dispense the beverage from the bottle for consumption. Often, the bottle is initially sealed to prevent air from entering the bottle prior to consumption.

Other types of containers for consumables include lunch boxes, which commonly include a box-shaped container and a lid which is hinged to the container to close the container. Fruits, vegetables, sandwiches, and other consumables are placed in the container and the lid closed until the consumables are consumed by a user.

It is known that packaging consumables in a vacuum environment preserves the freshness of the consumables until their consumption. When air is present instead, oxygen reacts with chemical groups in food and beverages, resulting in oxidation, which causes the food to spoil or become stale. Additionally, aerobic microorganisms flourish in an oxygen environment, accelerating spoilage of the consumables.

In consuming a beverage from a bottle, a consumer often desires to initially consume only a portion of the beverage while saving the rest of the beverage. This typically requires that the user replace the cap on the neck of the bottle after the initial portion of the beverage is dispensed from the bottle. One of the limitations of consuming a beverage from a bottle is that the bottle cannot be re-sealed after the cap is removed from the bottle to access the beverage. Upon removal of the cap, air enters the bottle through the neck and fills the portion of the bottle interior which is not occupied by the beverage. Consequently, in the case of soft drinks and other carbonated beverages, the carbon dioxide in the beverages escapes to the air in the bottle, causing the beverage to become flat. Moreover, the oxygen in the air may react with chemical components in the beverage, and this may adversely affect the taste of the beverage to a consumer.

Similarly, a common drawback of lunch boxes, coolers and other food containers is that air is typically not evacuated from the containers prior to placement of the consumables into the containers. After the container is opened to access a consumable and subsequently closed, air remains in the container, frequently causing the consumable to spoil or become stale unless the consumable is consumed after a short period of time.

Accordingly, there is an established need for a consumables container assembly having a container for containing consumables and an air-extracting device which can be deployed to evacuate air from the container to maintain the freshness of the consumables.

SUMMARY OF THE INVENTION

The present invention is directed to a consumables container assembly having a container including a flexible, internal bag for containing consumables and an air-extracting device which can be operated to evacuate air from the internal bag to maintain the freshness of the consumables. An illustrative embodiment of the consumables container assembly may include a bottle-shaped container having a bottom wall, a sidewall extending from the bottom wall, a shoulder extending from the sidewall, a neck extending from the shoulder and a container interior or interior space formed by the bottom wall, sidewall, shoulder and neck. A removable cap may be attached to the neck. A one-way valve may be provided in the cap. The one-way valve may have a plate. At least one valve opening may extend through the plate. A flexible or deformable membrane may be attached to the plate. The membrane may normally cover and seal the valve opening or openings in the plate when a beverage is contained in the interior space and the cap is attached to the neck to seal the interior space. An air extracting device may include a barrel having an interior space. A plunger may be slidably disposed in the interior space of the barrel. After it is removed from the neck to dispense a portion of the beverage from the interior space, the cap may be replaced on the neck. The barrel of the air extracting device may be placed in fluid communication with the membrane of the cap and the plunger pulled in the barrel to apply negative pressure to the membrane. The membrane may deform to expose the valve opening or openings in the plate and facilitate evacuation of air from the interior space through the valve opening or openings into the interior space of the barrel. Upon removal of the air-extracting device from the cap, the membrane may recoil back to the sealing position and the cap again attached to the neck. Thus, the resulting vacuum or reduced pressure in the interior space may preserve or maintain the freshness of the remaining portion of the beverage until it is ultimately dispensed from the container and consumed.

In some embodiments, the container may be shaped in the form of a rectangular, round, oval or polygonal box. A container lid may be pivoted to or removable from the container. The one-way valve may include a membrane opening which extends through the container lid. A lid plate may be provided in the membrane opening. The valve opening or openings may extend through the lid plate. A lid membrane may be provided in the membrane opening over the lid plate. Food and/or other consumables may be placed in the interior space of the container, after which the container lid may be closed on the container. The air extracting device may be deployed and operated to deform the lid membrane and evacuate air from the interior space through the vent or openings in the lid plate to preserve the freshness of the consumables.

In a first implementation of the invention, a consumables container assembly may include a container defining an interior space, and a one-way valve provided in the container. The one-way valve may be configured to selectively adopt a sealing position and an unsealing position in which the one-way valve opens or closes, respectively, one or more valve openings formed through the container. The container assembly may further include a flexible and deformable, internal bag arranged within the interior space of the container and defining an interior space. A first section of the internal bag may be airtightly attached to an inner side of the container in an area encircling the one or more valve openings, and other sections of the internal bag may be detachable from the container and may be collapsible. The container assembly may further include an air extracting device selectively disposable in fluid communication with the one-way valve. The air extracting device may be operable to apply negative pressure to the one-way valve to move the one-way valve to the unsealing position and suction air from the interior space of the internal bag via the one or more valve openings in the container.

In a second aspect, the container may include a bottom wall, a sidewall extending from the bottom wall, a shoulder extending from the sidewall, and a neck extending from the shoulder. The interior space of the container may be defined by the bottom wall, sidewall, shoulder, and neck. The area encircling the one or more valve openings may be arranged at the neck of the container.

In another aspect, the container may further include one or more vent openings formed therethrough and providing fluid communication between an outside of the container and an area of the interior space of the container located outside the interior space of the internal bag.

In another aspect, the container may further include a container body and a cover. The cover may be selectively movable relative to the container body between a closed position and an open position. In the closed position, the cover and container body may enclose the interior space of the container. In the open position, the cover may allow access to the interior space of the internal bag housed within the interior space of the container.

In another aspect, the container may further include one or more vent openings formed through the container body. The vent opening(s) may provide fluid communication between an outside of the container and an area of the interior space of the container located outside the interior space of the internal bag when the cover is arranged in the closed position.

In yet another aspect, the container may further include one or more vent openings formed through the cover. The vent opening(s) may provide fluid communication between an outside of the container and an area of the interior space of the container located outside the interior space of the internal bag when the cover is arranged in the closed position.

In another aspect, the one-way valve may be comprised in the cover of the container.

In another aspect, the internal bag may include a first bag portion and a separate, second bag portion, carried by the cover and the container body, respectively. A top edge of the first bag portion may provide the first section of the internal bag which may be airtightly attached to the inner side of the container. A bottom edge of the first bag portion may be airtightly attached to a bottom edge of the cover. An intermediate section of the first bag portion may be detachable from the cover and may be collapsible. In turn, a top edge of the second bag portion may be airtightly attached to a top edge of the container body, and a remainder of the second bag portion may be detachable from the container body and may be collapsible.

In another aspect, when the cover is arranged in the closed position, the first and second bag portions jointly define the interior space of the internal bag.

In yet another aspect, the one-way valve may include a plate formed in the container, the one or more valve openings formed through the plate. The one-way valve may further include a flexible or deformable membrane attached to the plate. In the sealing position of the one-way valve, the membrane may be arranged against the plate and may cover the one or more valve openings. In the unsealing position of the one-way valve, the one-way valve may be deformed away from the plate and may uncover the one or more valve openings.

In another aspect, the plate may be provided in a recessed area of the container.

In another aspect, the container assembly may further include a plug attaching the membrane to the plate.

In another aspect, the plate may be provided on the cover of the container.

In yet another aspect, the plate may be integrally formed with the cover.

In another aspect, the one-way valve may be configured to move to the sealing position upon removal of the air-extracting device from the one-way valve.

In another aspect, the air extracting device may include a barrel and a plunger slidably disposed in the barrel.

In another aspect, the barrel of the air extracting device may include an insertion end and an opposite plunger end. The insertion end may be airtightly fittable over and around the one-way valve. The plunger may extend from the plunger end.

In yet another aspect, the one-way valve may be provided in a recessed portion of the container, and the insertion end of the barrel may be fittable into the recessed area, over and around the one-way valve.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
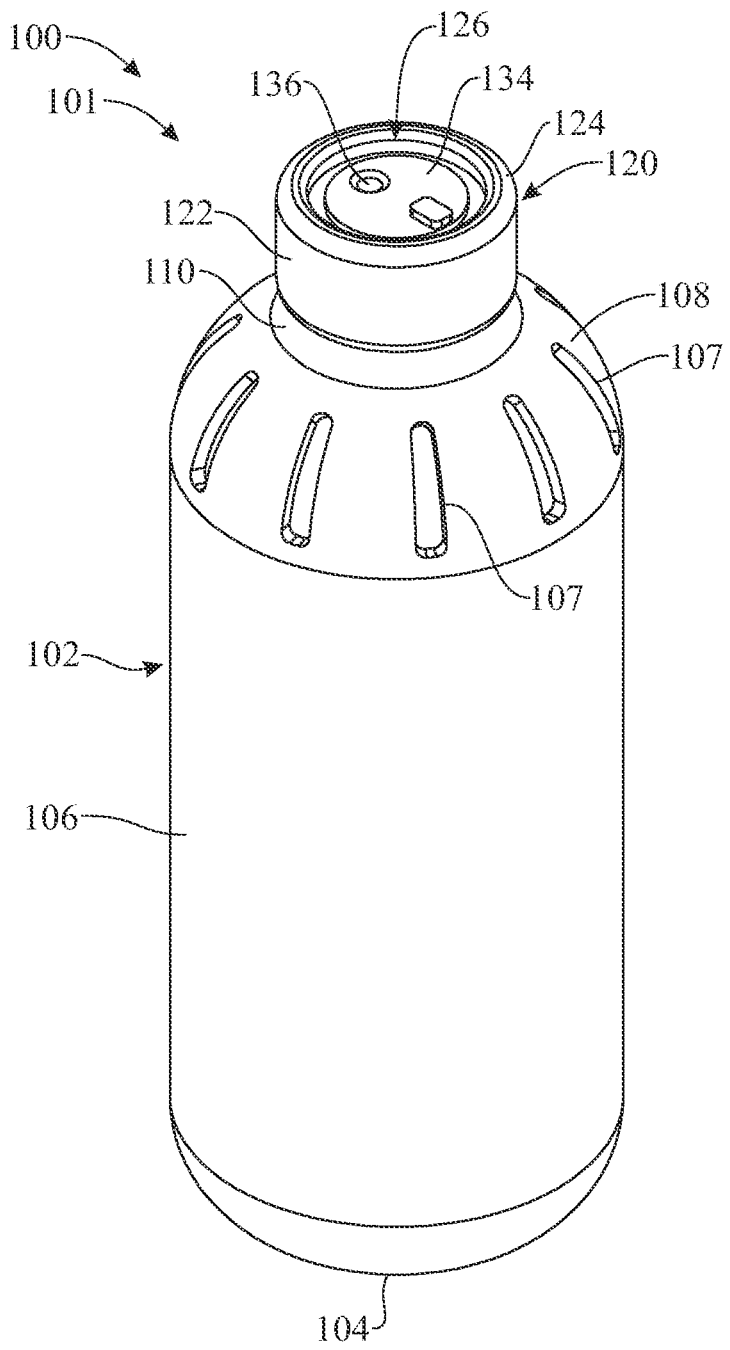
FIG. 1 presents a top perspective view of a first illustrative embodiment of the consumables container assembly of the present invention.
Figure 2:
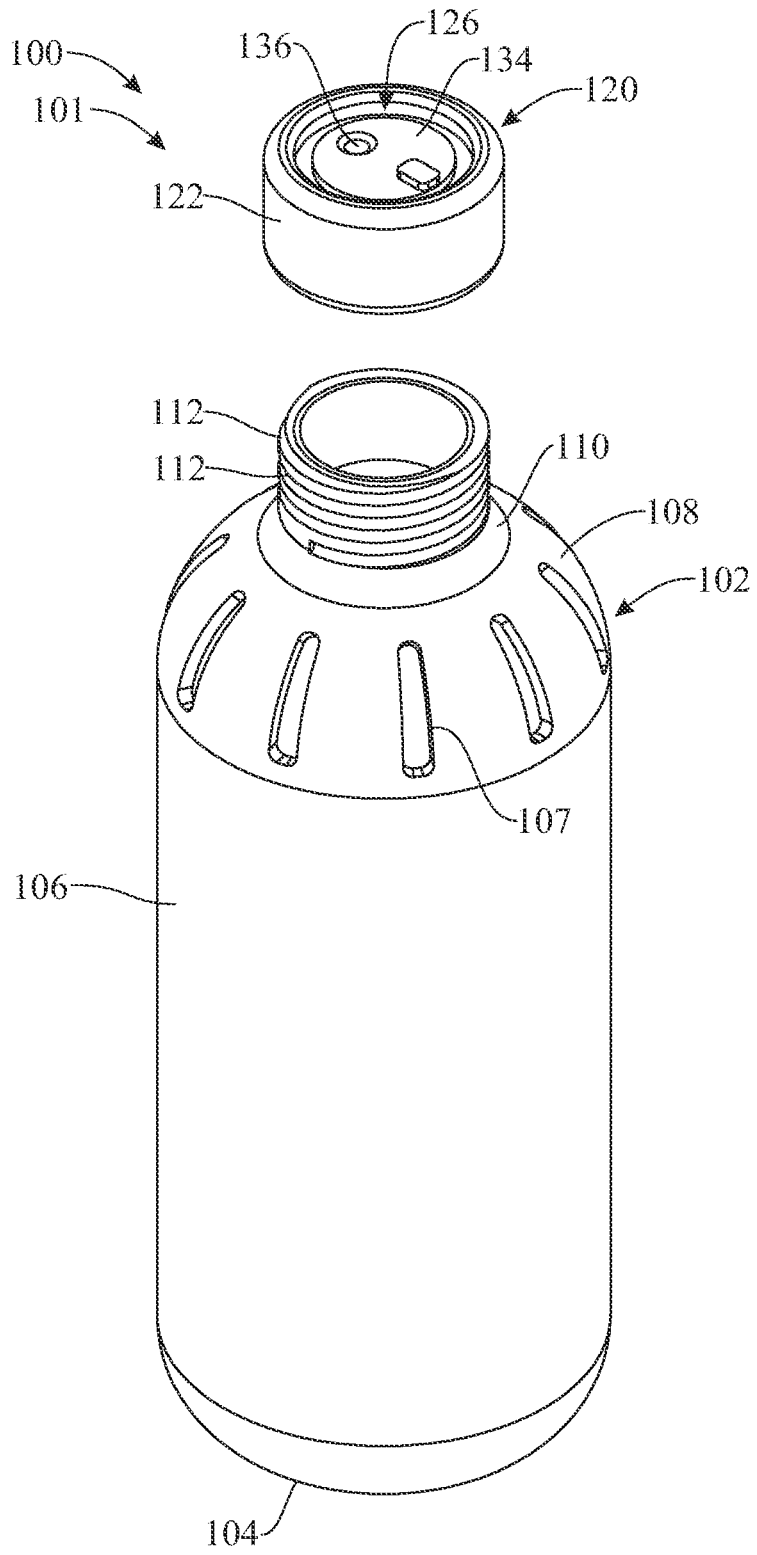
FIG. 2 presents an exploded top perspective view of the first illustrative embodiment of the consumables container assembly of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a consumables container assembly having a container including a collapsible internal bag for containing consumables and an air-extracting device which can be operated to evacuate air from the internal bag of container to maintain the freshness of the consumables.

Referring initially to FIGS. 1-7, a consumables container assembly, hereinafter container assembly 100, is illustrated in accordance with an exemplary embodiment of the present invention. The container assembly 100 may include a container 101 comprising a container body 102 and a cover or cap 120. The container body 102 has a container interior or interior space 116 (FIG. 6) and is configured to store a beverage or other consumable product within said interior space 116. In some embodiments, the container body 102 may generally approximate the size and shape of a bottle. The container body 102 may have a container bottom or bottom wall 104, a sidewall 106 extending from the bottom wall 104, a shoulder 108 extending from the sidewall 106, and a neck 110 extending from the shoulder 108. One or more openings 107 may extend through the container body 102, such as through the shoulder 108. The one or more vent openings 107 provide fluid communication between the outside of the container body 102 and the interior space 116 of the container body 102, for purposes that will be described hereinafter. In some embodiments, such as the present embodiment, the vent opening(s) 107 may be permanently open, i.e. provide permanent fluid communication through the container body 102.

The cap 120 may be detachably attached to the neck 110 of the container body 102. The cap 120 may have a cylindrical sidewall 122. A rim 124 may terminate the sidewall 122 of the cap 120. In some embodiments, the sidewall 122 of the cap 120 may be interiorly threaded to threadably engage threads 112 (FIG. 2) on the neck 110. In some embodiments, such as the present embodiment, the threads 112 may be provided on an outer side of the neck 110, and the cap sidewall 122 may be threaded on an inner side thereof.

Figure 3:
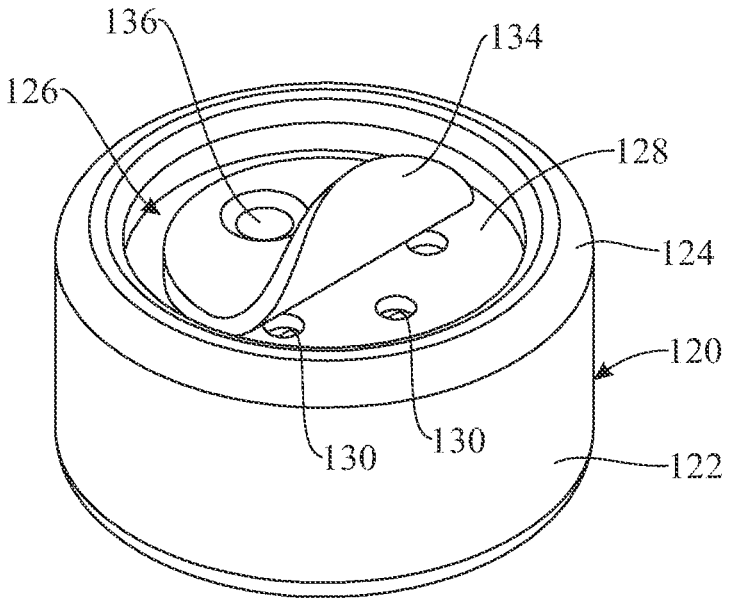
FIG. 3 presents a perspective view showing a cap suitable for an illustrative embodiment of the consumables container assembly of the present invention, with the membrane of the one-way valve shown in a deformed, unsealing position.
Figure 6:
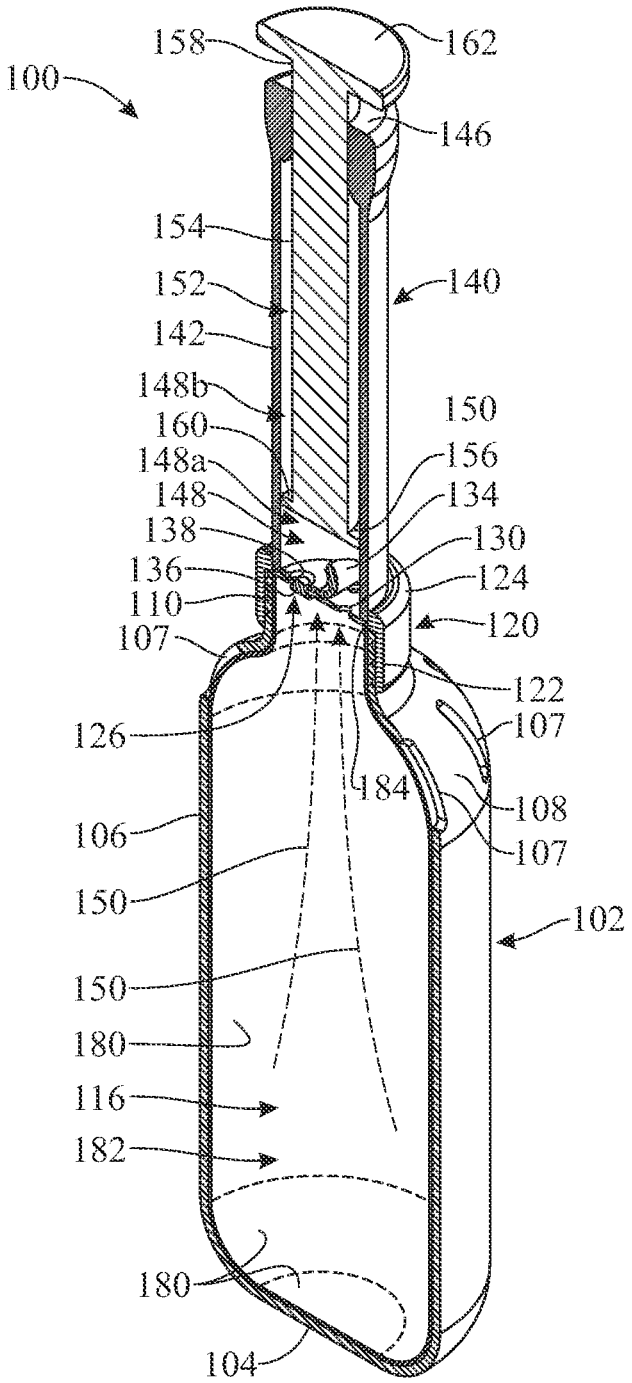
FIG. 6 presents a longitudinal sectional perspective view of the first illustrative embodiment of the consumables container assembly with the air extracting device deployed in place and the plunger shown starting to be pulled upward in order to suction air from inside the internal bag housed within the interior space of the container.
Figure 7:
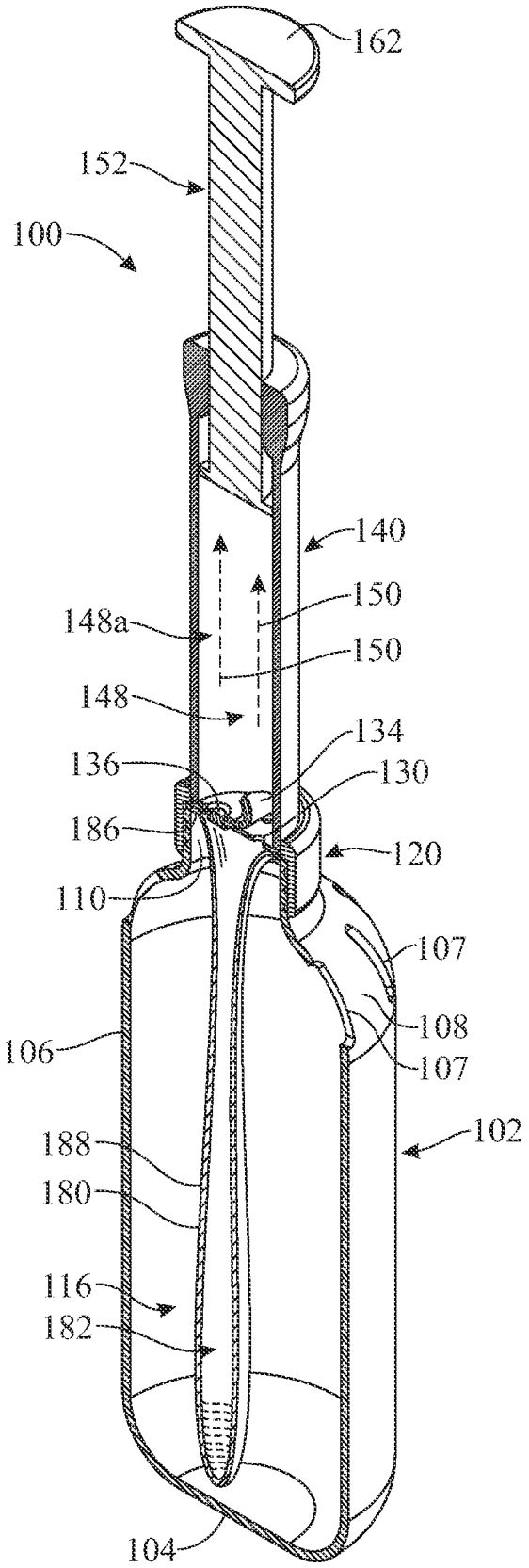
FIG. 7 presents a longitudinal sectional perspective view similar to FIG. 6, showing the plunger pulled further upward in relation to the previous figure, said further pulling causing the internal bag to collapse against its contents.
Figure 8:
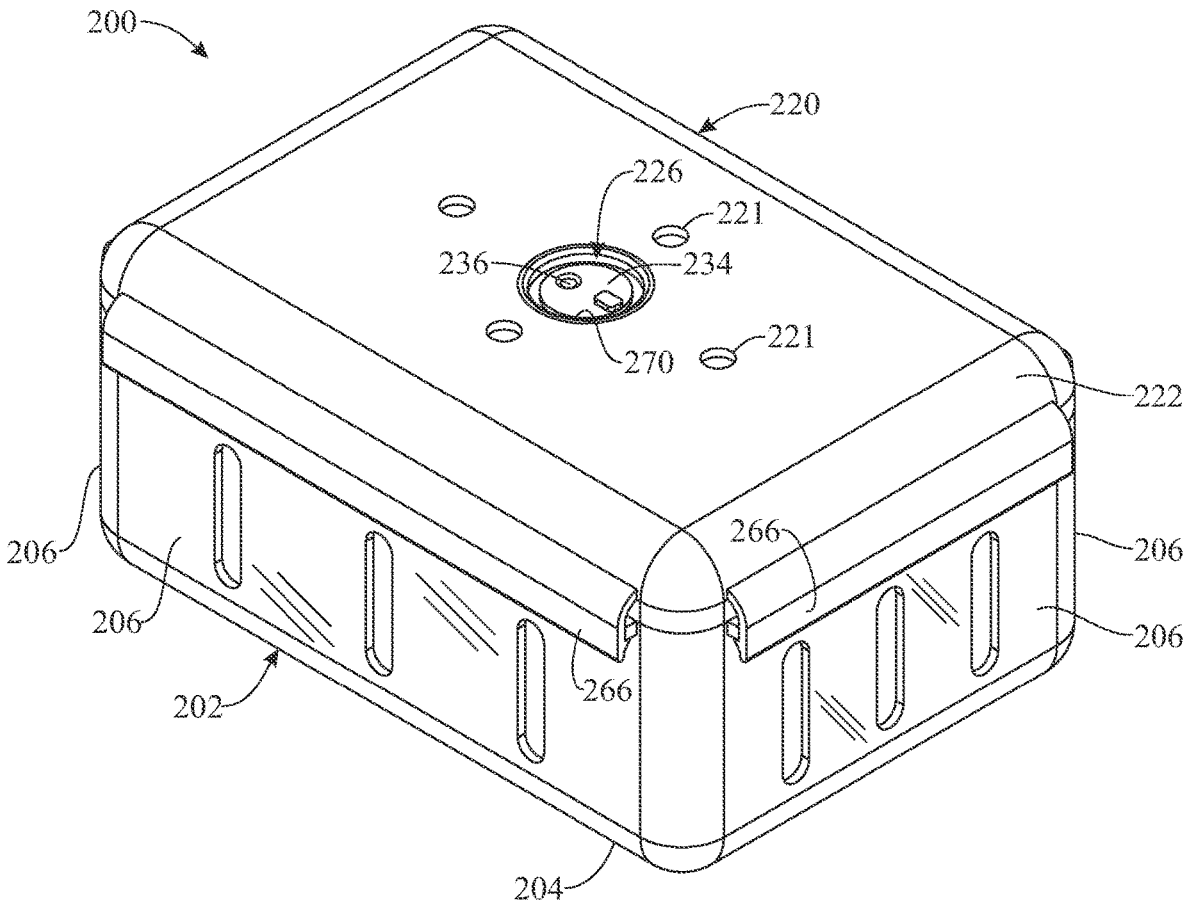
FIG. 8 presents a top perspective view of a second illustrative embodiment of the consumables container assembly of the present invention.

As illustrated in FIGS. 3 and 6, a one-way valve 126 may be provided in the container cap 120. For example, in some embodiments, the cap 120 may include a plate 128 extending radially from the sidewalls 122 of the cap 120 to provide a top closure of the cap 120, as shown. The plate 128 may be inwardly recessed into the cap 120, below the rim 124 of the cap 120. At least one valve opening 130 may extend through the plate 128. As best shown in FIGS. 6 and 7, the at least one valve opening 130 may communicate with the interior space 116 of the container body 102 when the cap 120 is attached to the neck 110. A flexible or deformable membrane 134, formed for instance as a relatively thin, planar plate or sheet, as shown, may be attached to the plate 128 exterior to the interior space 116 of the container body 102, such as on an outer side of the plate 128 opposite to the interior space 116, as further illustrated. The membrane 134 may be attached to the plate 128 by mechanical means, an adhesive, a magnet, and/or other applicable means according to the knowledge of those skilled in the art. For example, as illustrated in FIG. 3, in some embodiments, a plug 136 may attach the membrane 134 to the plate 128. The plug 126 may be integrally formed into a single-piece unit with the membrane 134, and extend downward from the membrane 134 to snugly fit into a plug opening 138 formed in the plate 128, as shown in FIG. 6. Alternatively, the plug 126 may be a separate part or fastener, which may extend through the membrane 134 and through the plug opening 138 to secure the membrane 134 to the plate 128. The membrane 134 of the present embodiment is movable relative to the plate 128 in order to selectively block or allow air passage through the valve openings 130. More specifically, the membrane 134 may be deployable between a sealing position (FIGS. 1 and 2) in which the membrane 134 covers and seals the valve openings 130 and an unsealing position (FIGS. 3, 6 and 7) in which the membrane 134 uncovers and unseals the valve openings 130, as will be hereinafter further described.

Figure 4:
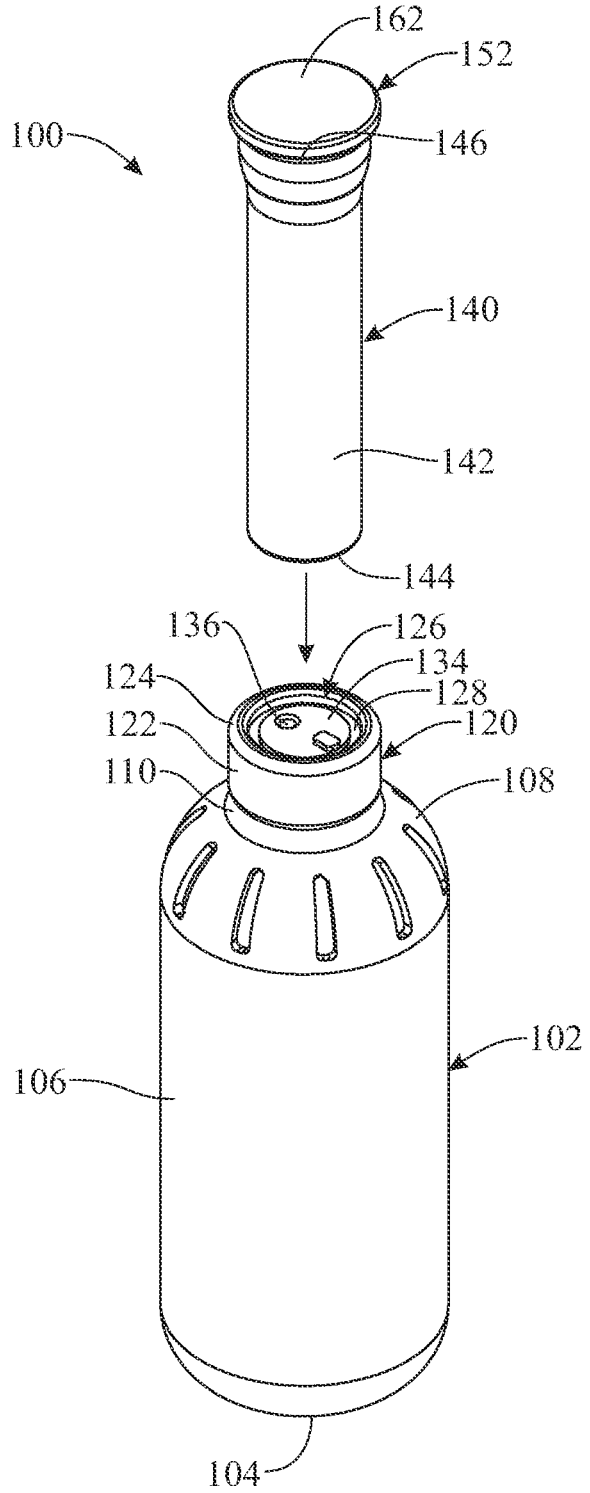
FIG. 4 presents an exploded top perspective view of the first illustrative embodiment of the consumables container assembly of the present invention, more particularly illustrating deployment of the air extracting device in fluid communication with the cap.
Figure 5:
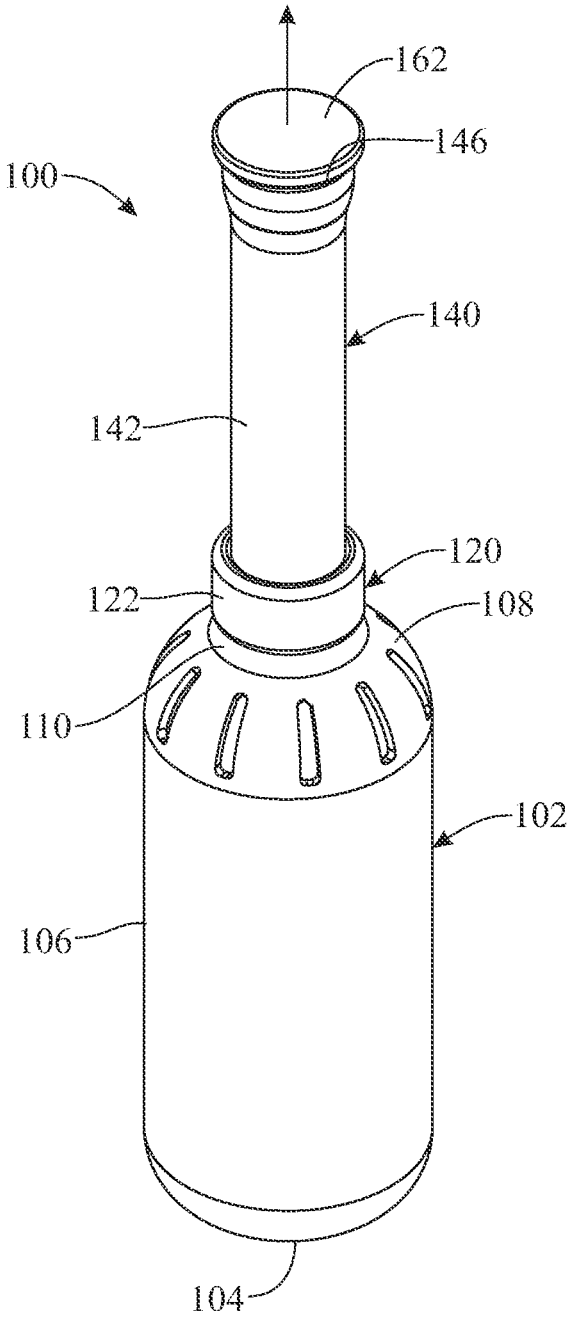
FIG. 5 presents an exploded perspective view of the first illustrative embodiment of the consumables container assembly of the present invention, with the air extracting device in place and being operated to remove air from the container through the one-way valve.

As illustrated in FIGS. 4-6, the consumables container assembly 100 may further include an air extracting device 140, which may be selectively deployable in a usage or operational position in which the air-extracting device 140 is in fluid communication with the one-way valve 126 in the cap 120 (FIGS. 5-7), and in a storage or transport position in which the air-extracting device 140 is disconnected from the cap 120 (FIG. 4). The air-extracting device 140 may have any design which is suitable for the purpose. However, in some preferred embodiments, the air-extracting device 140 may include a barrel 142 which may be elongated and cylindrical. As best shown in FIG. 4, the barrel 142 may have an insertion end 144 and a plunger end 146. A barrel interior or interior space 148, shown for instance in FIG. 6, may be defined within and extend through the barrel 142 from the insertion end 144 to the plunger end 146.

As illustrated in FIG. 6, a plunger 152 may be slidably disposed in the interior space 148 of the barrel 142. The plunger 152 may include an elongated shaft 154 having a first or head end 156 and a second or handle end 158. A head 160 may terminate the head end 156 of the shaft 154. The head 160 may sealingly engage the interior surface of the barrel 142, thereby delimiting a first sub-space or chamber 148*a* within the interior space 148; for instance, in some embodiments, such as the present embodiment, the head 160 may be wider (have a larger diameter or width) than the shaft 154, and the head 160 may divide the interior space 148 into two sub-spaces or chambers, i.e. the aforementioned first subs-space or chamber 148*a*, and a second subs-space or chamber 148*b* located on an opposite, upper side of the head 160. The shaft 154 may extend from the interior space 148 of the barrel 142, beyond the plunger end 146 of the barrel 142 and outwardly of the barrel 142. A handle 162 may terminate or be provided at the handle end 158 of the shaft 154, to facilitate pulling and/or pushing the plunger 150 relative to the barrel 142.

As further illustrated in FIG. 4, the insertion end 144 of the barrel 142 may be suitably sized and configured for insertion into the cap 120 until the insertion end 144 engages the plate 128 of the one-way valve 126. In some embodiments, the insertion end 144 is fitted onto the cap 120 such that a substantially airtight connection is formed between the insertion end 144 and the cap 120. For instance, in the present embodiment, the insertion end 144 may seal against the plate 128, against the membrane 134 (which is surrounded by and fitted within the insertion end 144 of the barrel 142), and/or against the rim 124 of the cap 120.

Upon extension from the interior space 148 of the barrel 142 (FIG. 6), the plunger 152 may induce negative pressure in the first chamber 148*a* of the interior space 148 of the barrel 142. The negative pressure may exert a pulling or suction force on the membrane 134 towards the first chamber 148*a* of the interior space 148 of the barrel 142 and away from the plate 128. Said force may deform the membrane 134 from the sealing position to the unsealing position, exposing the valve openings 130 in the plate 128 such that the negative pressure is induced in the interior space 116 of the container body 102 through the valve openings 130. The negative pressure evacuates air 150 from the container body 102 as will be described in greater detail hereinafter.

In this way, the air extracting device 140 may be relatively compact, and preferably portable, and can be easily manually operable by a user for purposes that will be described hereinafter. In addition, when not in use, the air extracting device 140 may be detached from the container 101 and conveniently stored.

Though not specifically shown herein, it should be understood by those skilled in the art that the consumables container assembly 100 may additionally include one or more flexible gaskets or seals to facilitate an airtight coupling of the different parts, where applicable. For example, one or more flexible seals may be arranged between the container body 102 and cap 120. In another example, one or more flexible seals may be provided between the insertion end 144 of the barrel 142 and the cap 120. In yet another example, the head 160 may carry one or more flexible seals configured to sealingly engage the interior surface of the barrel 142. The seals can be made of rubber, silicone, or other applicable flexible materials.

As shown in FIG. 6, the container body 102 may further include a flexible, internal liner or bag 180 arranged within the interior space 116. In some embodiments, the internal bag may be stretchable. The internal bag 180 comprises an interior space 182 that ends in a top opening 184 which is in fluid communication with the cap 120, and more particularly, with the one-way valve 126 of the cap 120 in order to allow air from the interior space 182 of the internal bag 180 to be extracted through the cap 120. For instance, in the depicted embodiment, the top opening 184 of the internal bag 180 is arranged at a top end of the neck 110 of the container body 102 and at an underside of the plate 128 of the cap 120. The internal bag 180 can be made of flexible plastic, rubber, silicone, a gel or gel-like material, or combinations thereof, for instance and without limitation. A top portion of the internal bag 180 is secured to a top portion of the container body 102, while a bottom portion of the internal bag 180, which extends from the top portion of the internal bag, is not attached or adhered, and is separable from, a bottom portion of the container body 102. For example, in the present embodiment, the top portion and bottom portion of the internal bag 180 are provided or constituted by a top edge 186 and a main body 188 of the internal bag 180, respectively. In turn, the top portion of the container body 102 is constituted by a top edge of the neck 110, while the bottom portion of the container body 102 is constituted by a remainder of the neck 110, the shoulder 108, the sidewall 106 and the bottom wall 104. In other words, in the present embodiment, the top edge 186 of the internal bag 180 is secured to the top edge of the neck 110, while the main body 188 of the internal bag 180 is not secured to the remainder of the container body 102.

The internal bag 180 can adopt an expanded position, shown in FIG. 6. In the expanded position, the internal bag 180 can be arranged adjacent to or against an inner side of the sidewall 106, shoulder 108 and neck 110, as shown. Alternatively, the internal bag 180 can deformably adopt a compressed or collapsed position, an example of which is shown in FIG. 7. In the compressed position, the main body 188 of the internal bag 180 is collapsed inwardly or separated from the container body 102 while the top edge 186 of the internal bag 180 remains attached to the top edge of the neck 110.

In an illustrative application of the container assembly 100, a liquid beverage (not shown) may be placed in the interior space 182 of the internal bag 180 (FIG. 6) of the container body 102 for storage and/or transport and ultimate consumption of the beverage. For this purpose, the cap 120 may be removed from the neck 110 of the container body 102, and the beverage may be poured or otherwise placed through the top opening 184 of the internal bag 180 and into in the interior space 182 of the internal bag 180, with the internal bag 180 arranged in, or substantially in, the expanded position of FIG. 6. The cap 120 may then be replaced on the neck 110 such as by threading the cap 120 on the threads 112 of the neck 110.

Because the interior space 116 is exposed to the atmosphere as the beverage is placed in the interior space 182 of the internal bag 180, air enters the interior space 182 through the top opening 184 of the internal bag 180 while the cap 120 is removed, and remains in the interior space 182 above the liquid beverage after the cap 120 is replaced on the neck 110. In order to evacuate this air, the air-extracting device 140 is used next. More specifically, as illustrated in FIGS. 4 and 5, the insertion end 144 of the barrel 142 is inserted in the cap 120 and preferably seals against one or more areas of the cap. As illustrated in FIG. 6, when fitting the barrel 142 into the cap 120, the rim 124 of the cap 120 may encircle the insertion end 144 of the barrel 142, which in turn may engage the plate 128 of the one-way valve 126 in encircling relationship to the membrane 124.

With continued reference to FIG. 6, the plunger 152 may initially be deployed in the retracted position in the barrel 142, and may start to be pulled rearward, i.e. extended from the barrel 142, by pulling on the head 162. As the plunger 152 is extended from the barrel 142, the plunger 152 induces a negative pressure or depression in the first chamber 148*a* of the interior space 148 of the barrel 142. The negative pressure may pull on the membrane 134 and deform the membrane 134 from the sealing position of FIGS. 1 and 2 to the unsealing position of FIGS. 3 and 6, while the membrane 134 remains attached to the plate 128 by the plug 126. In adopting the unsealing position of FIGS. 3 and 6, the membrane 134 uncovers the valve openings 130, and the negative pressure in the first chamber 148*a* of the barrel 142 draws the air 150 from the interior space 182 of the internal bag 180, through the neck 110 and the valve openings 130 in the membrane 134 and into the first chamber 148*a* of the interior space 148 of the barrel 142. Air being drawn from the interior space 182 of the internal bag 180 causes a depression within the interior space 182 that pulls inward on the internal bag 180. Said inward pulling causes outside air to be suctioned into the interior space 116 of the container body 102 via the vent openings 107 in the container body 102, and more specifically, from outside the container body 102 to an area of the interior space 116 of the container body 102 located outside the interior space 182 of the internal bag 180. This allows the internal bag 180 (and more specifically, the main body 188 thereof) to collapse or compress while the top edge 186 of the internal bag 180 remains attached to the neck 110. The internal bag 180 is deformed by suction into a compressed position (for example, that of FIG. 7), in which the internal bag 180 can seal against the liquid and/or solid product(s) contained within the interior space 182 of the internal bag 180, contributing to better insulate the product(s) from air and/or harmful agents and preserve the product(s).

Once the internal bag 180 is deformed to a compressed state in which all or part of the air contained in the interior space 182 has been extracted by the air extracting device 140, the barrel 142 of the air extracting device 140 may subsequently be removed from the cap 120 such that, by a suctioning effect from the interior space 182 of the internal bag 180, the membrane 134 is pulled towards to the unsealing position to the sealing position and cover and seal the valve openings 130 in the plate 128. In some embodiments, the membrane 134 may be elastically deformable such that it is elastically biased to return to the sealing position. Thus, the beverage in the interior space 116 may remain in a fresh state until it is subsequently consumed at a later time. Each time the cap 120 is removed from the neck 110 to access the beverage in the interior space 116, and subsequently placed on the container body 102, the same procedure may be carried out using the air-extracting device 140 to prolong the freshness of the beverage which remains in the interior space 116.

Figure 9:
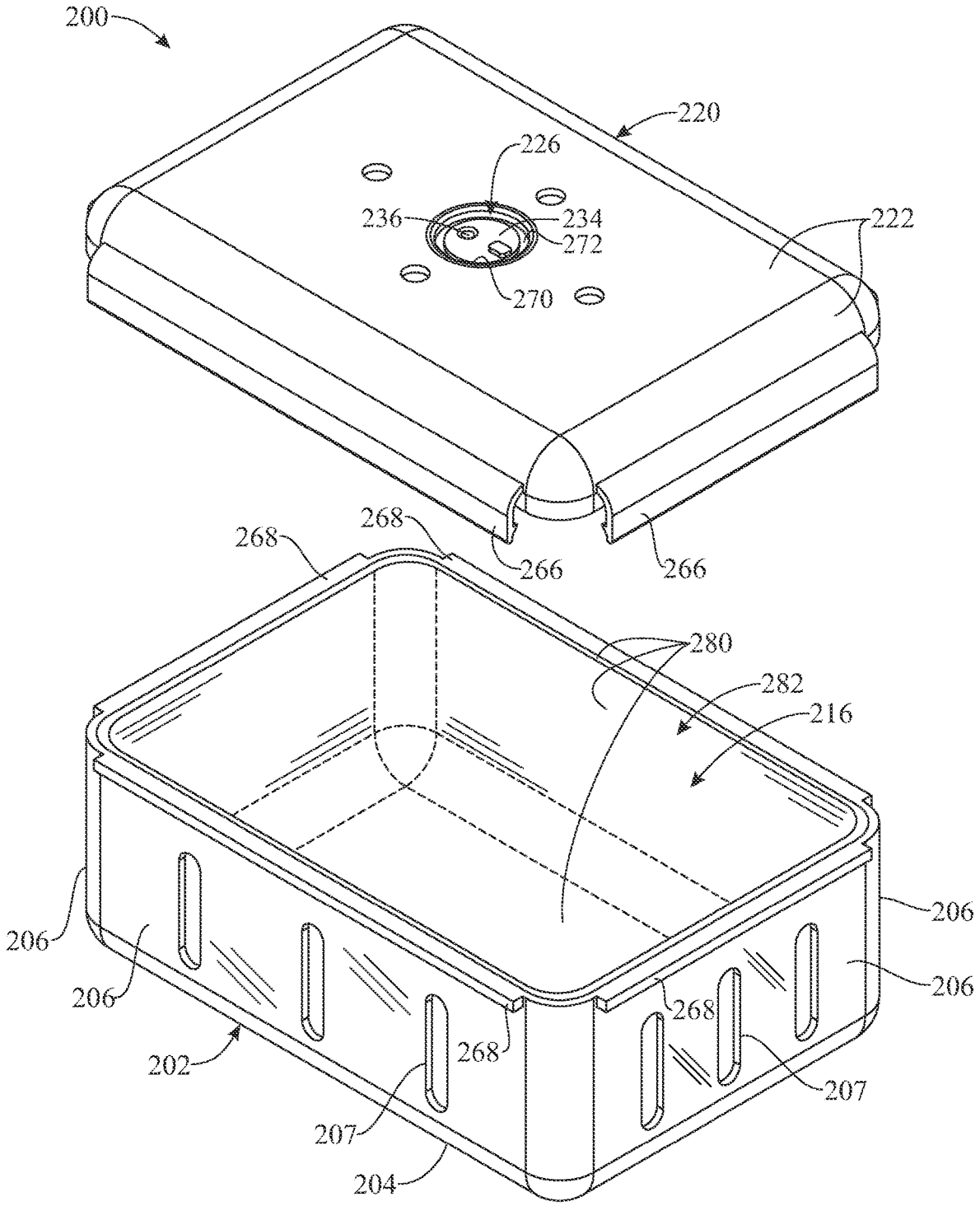
FIG. 9 presents an exploded top perspective view of the second illustrative embodiment of the consumables container assembly of the present invention.
Figure 10:
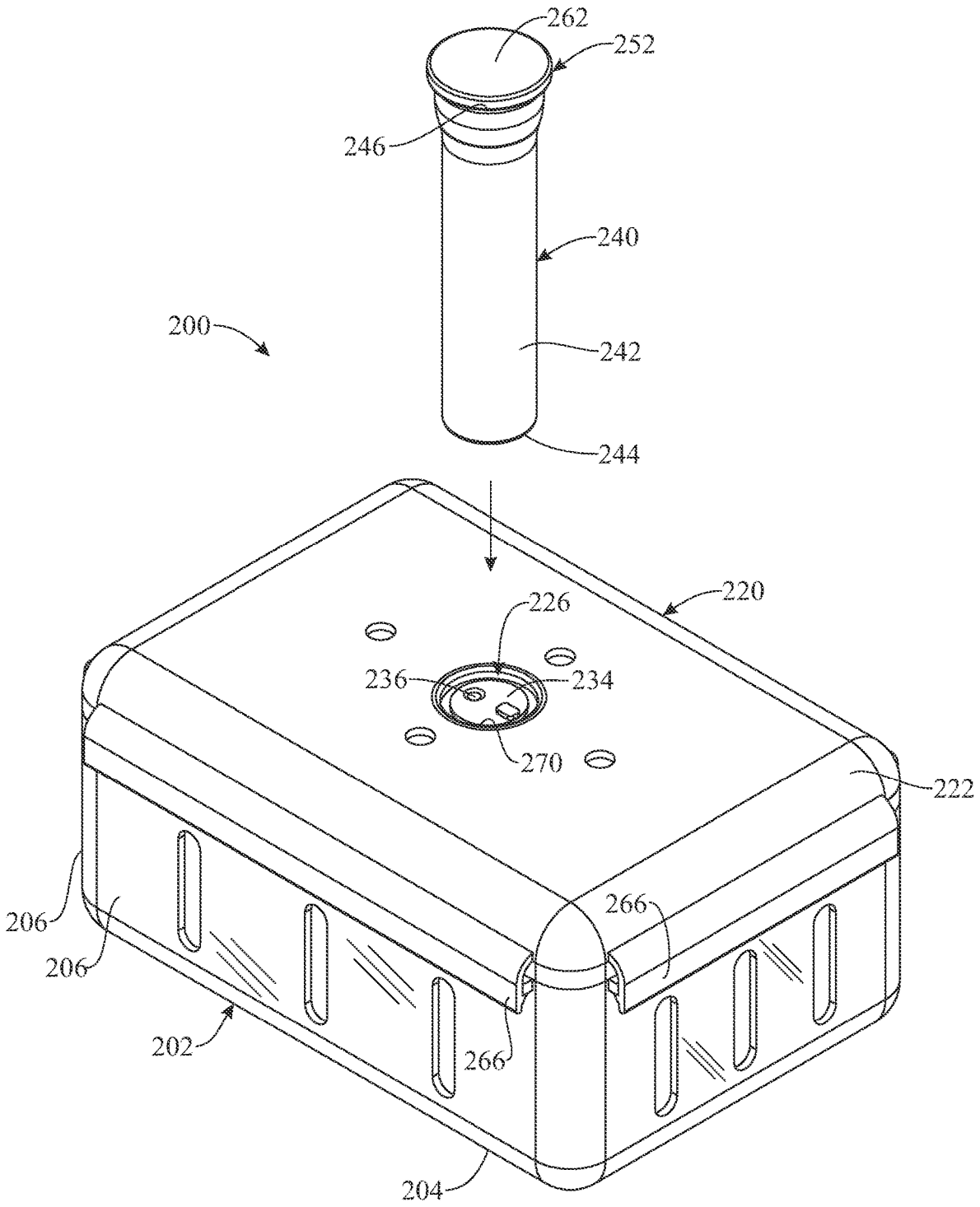
FIG. 10 presents an exploded top perspective view of the second illustrative embodiment of the consumables container assembly of the present invention, more particularly illustrating deployment of the air extracting device in fluid communication with the one-way valve.
Figure 11:
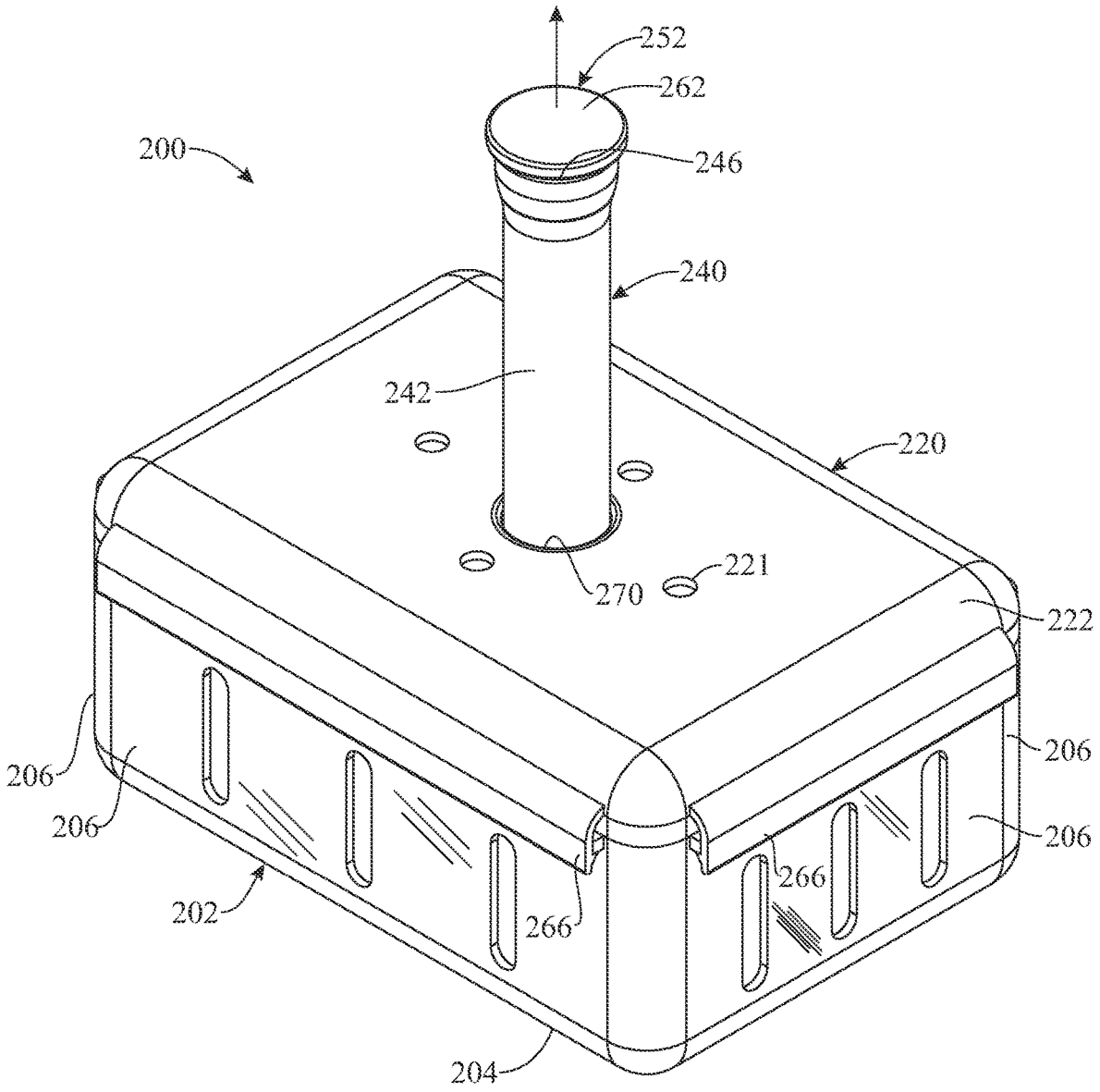
FIG. 11 presents an exploded top perspective view of the second illustrative embodiment of the consumables container assembly of the present invention, with the air extracting device in place and being operated to remove air from the container through the one-way valve.

Referring next to FIGS. 8-13, an alternative illustrative embodiment of the consumables container assembly in accordance with the present disclosure is generally indicated by reference numeral 200. In the container assembly 200, elements which are functionally analogous to the respective elements of the container assembly 100 that was heretofore described with respect to FIGS. 1-7 are designated by the same respective numerals in the 200-299 series in FIGS. 8-13. The container assembly 200 of the present embodiment includes a container comprising a container body 202 and a container cover or lid 220. It should be noted that, while the container body 202 of the container assembly 200 of the present embodiment is generally rectangular, the container could have alternative shapes such as, but not limited to, round, oval, square, or polygonal. The container lid 220 may be opened and closed relative to the container body 202. For instance, in some embodiments, such as the present embodiment, the container lid 220 may be pivotably attached to from the container body 202. In other embodiments, the container lid 220 may be pivotally or hingedly mounted on the container body 202 according to the knowledge of those skilled in the art. As illustrated in FIG. 9, in some embodiments, lock tabs 268 may extend outwardly from the upper edge of the sidewall 206 of the container body 202. Lock flanges 266 may extend from the lid wall 222 of the container lid 220. The lock flanges 266 may detachably engage the respective lock tabs 268 to detachably secure the container lid 220 on the container body 202 in a closed position, shown in FIGS. 10-13. Furthermore, while not specifically shown herein, one or more flexible seals or gaskets can be provided between an upper edge of the container body 202 and a lower or outer edge of the container lid 220 for airtight engagement of one with the other.

Similarly to the previous embodiment, as shown, the one-way valve 226 of the present embodiment includes a lid plate 272 which is integrally formed with the lid 220 and is recessed from an edge 270 of the lid 220. One or more valve openings 230 are formed through the lid plate 272. A deformable, lid membrane 234 is attached to the lid plate 272 and is movable relative to the lid plate 272 between a sealing position and an unsealing position.

Figure 12:
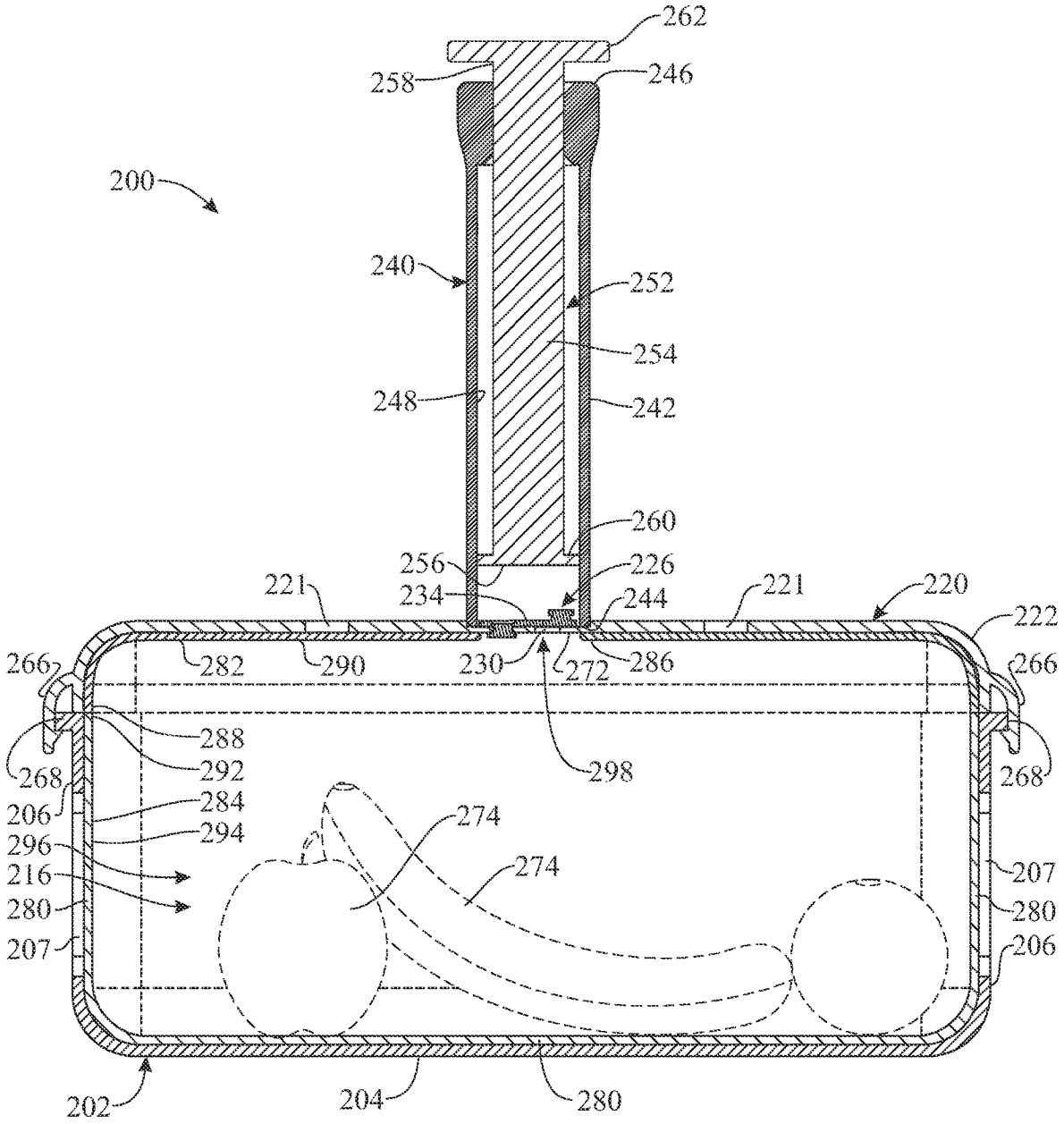
FIG. 12 presents a sectional view of the second illustrative embodiment of the consumables container assembly of the present invention, with the air extracting device disposed in fluid communication with the one-way valve preparatory to operation of the air extracting device.
Figure 13:
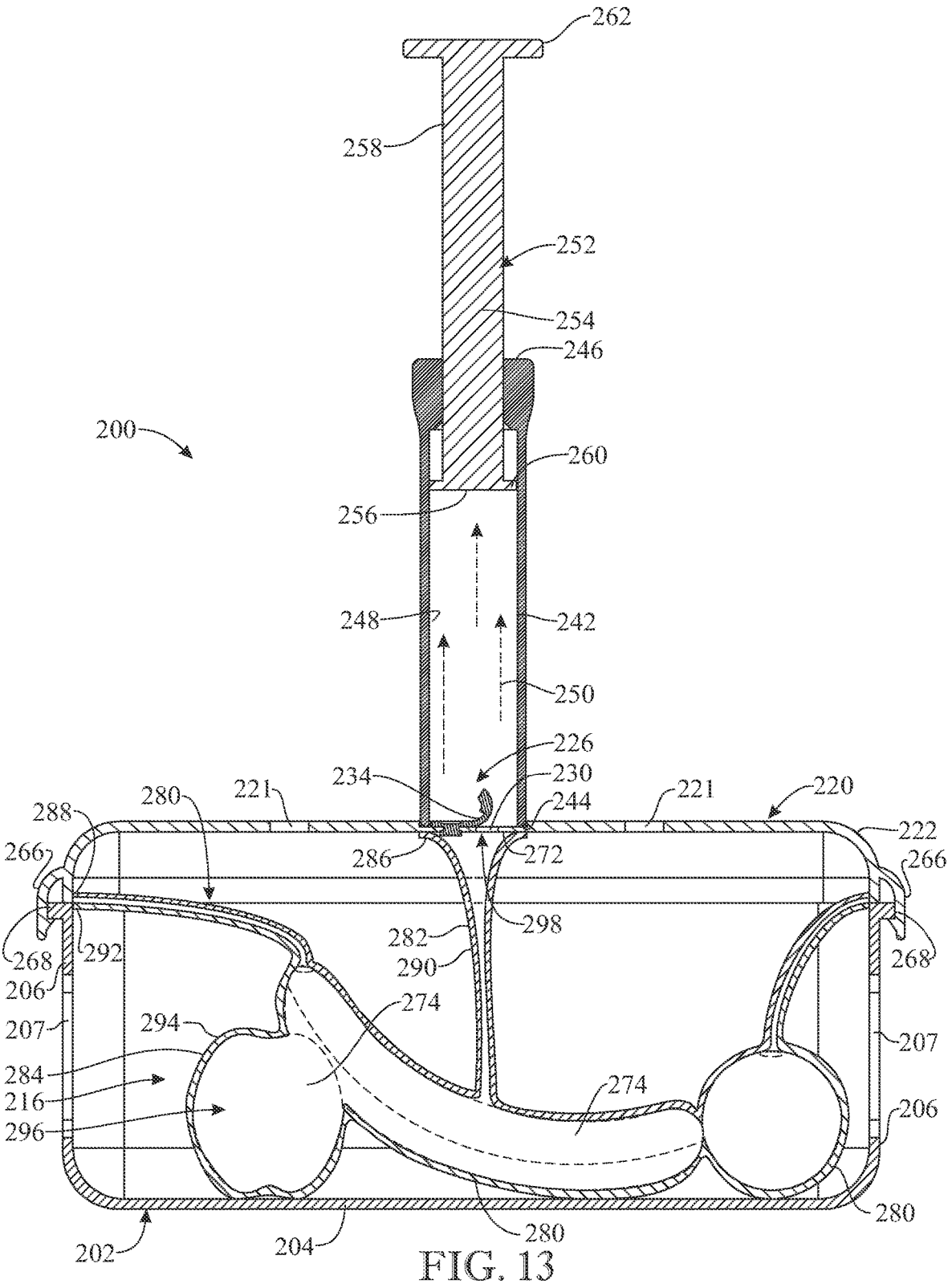
FIG. 13 presents a sectional view of the second illustrative embodiment of the consumables container assembly of the present invention, with the air extracting device in place and being operated to remove air from the container through the one-way valve.

As shown in FIGS. 9 and 12, the container assembly 200 of the present embodiment further includes a flexible, internal bag 280 formed by a flexible, first bag portion 282 and a flexible, second bag portion 284. The first bag portion 282 is carried by the container lid 220. A top edge 286 of the first bag portion 282 is adhered or attached to an inner side of the container lid 220 at or adjacent to the one-way valve 226 and sealingly encloses the one or more openings 230. In turn, a bottom edge 288 of the first bag portion 282 is adhered or attached to a bottom edge of the container lid 220. The remainder or separable portion 290 of the first bag portion 282 arranged between the top and bottom edges 286 and 288 is not attached to, and is separable from, an inner wall of the container lid 220. One or more vent openings 221 are formed through the container lid 220 facing said separable portion 190 of the first bag portion 282. In turn, the second bag portion 284 is carried by the container body 202 and arranged within the interior space 216 of the container body 202. A top portion, such as a top edge 292, of the second bag portion 284 is attached or adhered to a top edge of the container body 202, while a bottom portion, such as a main body 294, of the second bag portion 284 is not attached to and is separable from the container body 202. One or more vent openings 207 are formed through the container body 202 facing the separable, main body 294 of the second bag portion 284. The first and second bag portions 282 and 284 can adopt an assembled or engaged configuration, shown in FIGS. 12 and 13, in which the bottom edge 288 of the first bag portion 282 and the top edge 292 of the second bag portion 284 sealingly attach to or rest against one another, thereby enabling the first and second bag portions 282 and 284 to define an interior space 296 which ends in a top opening 298 and is otherwise airtight. The top opening 298 is delimited by the top edge 286 of the first bag portion 282 and is arranged in fluid communication with the one or more openings 230 of the one-way valve 226. The first and second bag portions 282 and 284 can further adopt an open configuration, shown in FIG. 9, in which they are separated from one another, such as when the container lid 220 is separated from the container body 202. Furthermore, when in the engaged configuration, the first and second bag portions 282 and 284 can deformably switch between an expanded configuration (FIG. 12) and a compressed or collapsed configuration (FIG. 13).

With the container assembly 200 arranged in an open position (FIG. 9) and thus the internal bag 280 arranged in the open configuration, food and/or other consumables 274 may be placed inside the second bag portion 284 in the container body 202, after which the container lid 220 may be closed on the container body 202 so that the internal bag 280 adopts the assembled or engaged configuration described heretofore. Next, as illustrated in FIGS. 12 and 13 and similarly to the previous embodiment, the barrel 242 of the air extracting device 240 may be connected to the one-way valve 226 and the plunger 252 may be extended from the barrel 242 to suction the lid membrane 234 and uncover the vent or opening(s) 230 in the lid plate 228. In consequence, air 250 is suctioned from the interior space 296 of the internal bag 280 while outside air is suctioned into the container 216 interior through the vent openings 207 and 221 formed in the container body 202 and container lid 220, respectively, causing the separable portion 290 of the first bag portion 282 and the main body 294 of the second bag portion 284 to be suctioned inward and compressed against the consumables 274 to minimize or remove any air adjacent the consumables 274 and thus and preserve the freshness of the consumables 274 for later consumption. The top and bottom edges 286 and 288 of the first bag portion 282 and the top edge 292 of the second bag portion 284 remain attached to the container lid 220 and container body 202, respectively, allowing the internal bag 280 to recover the expanded position of FIG. 12, such as when the container lid 220 is separated from the container body 202.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A consumables container assembly comprising:

a container defining an interior space;

a one-way valve provided in the container, the one-way valve configured to selectively adopt a sealing position and an unsealing position in which the one-way valve opens or closes, respectively, one or more valve openings formed through the container;

a flexible and deformable, internal bag arranged within the interior space of the container and defining an interior space, wherein a first section of the internal bag is airtightly attached to an inner side of the container in an area encircling said one or more valve openings, and other sections of the internal bag are detachable from the container and are collapsible; and an air extracting device selectively disposable in fluid communication with the one-way valve, wherein the air extracting device is operable to apply negative pressure to the one-way valve to move the one-way valve to the unsealing position and suction air from the interior space of the internal bag via the one or more valve openings in the container.

2. The container assembly of claim 1, wherein the container comprises a bottom wall, a sidewall extending from the bottom wall, a shoulder extending from the sidewall, and a neck extending from the shoulder, wherein the interior space of the container is defined by the bottom wall, sidewall, shoulder, and neck, and further wherein said area encircling said one or more valve openings is arranged at the neck of the container.

3. The container assembly of claim 1, wherein the container further comprises one or more vent openings formed therethrough and providing fluid communication between an outside of the container and an area of the interior space of the container located outside the interior space of the internal bag.

4. The container assembly of claim 1, wherein the container further comprises a container body and a cover, wherein the cover is selectively movable relative to the container body between a closed position and an open position, wherein, in the closed position, the cover and container body enclose the interior space of the container, and wherein, in the open position, the cover allows access to the interior space of the internal bag housed within the interior space of the container.

5. The container assembly of claim 4, wherein the container further comprises one or more vent openings formed through the container body and providing fluid communication between an outside of the container and an area of the interior space of the container located outside the interior space of the internal bag when the cover is arranged in the closed position.

6. The container assembly of claim 4, wherein the container further comprises one or more vent openings formed through the cover and providing fluid communication between an outside of the container and an area of the interior space of the container located outside the interior space of the internal bag when the cover is arranged in the closed position.

7. The container assembly of claim 4, wherein the one-way valve is comprised in the cover of the container.

8. The container assembly of claim 7, wherein the internal bag comprises a first bag portion and a separate, second bag portion, carried by the cover and the container body, respectively, wherein:

a top edge of the first bag portion provides said first section of the internal bag which is airtightly attached to the inner side of the container, and a bottom edge of the first bag portion is airtightly attached to a bottom edge of the cover, and further wherein an intermediate section of the first bag portion is detachable from the cover and is collapsible; and a top edge of the second bag portion is airtightly attached to a top edge of the container body, and a remainder of the second bag portion is detachable from the container body and is collapsible.

9. The container assembly of claim 8, wherein, when the cover is arranged in the closed position, the first and second bag portions jointly define the interior space of the internal bag.

10. The container assembly of claim 1, wherein the one-way valve comprises a plate formed in the container, the one or more valve openings formed through the plate, and a flexible or deformable membrane attached to the plate, wherein, in the sealing position of the one-way valve, the membrane is arranged against the plate and covers the one or more valve openings, and further wherein, in the unsealing position of the one-way valve, the one-way valve is deformed away from the plate and uncovers the one or more valve openings.

11. The container assembly of claim 10, wherein the plate is provided in a recessed area of the container.

12. The container assembly of claim 10, further comprising a plug attaching the membrane to the plate.

13. The container assembly of claim 12, wherein the container further comprises a container body and a cover, wherein the cover is selectively movable relative to the container body between a closed position and an open position, wherein, in the closed position, the cover and container body enclose the interior space of the container, and wherein, in the open position, the cover allows access to the interior space of the internal bag housed within the interior space of the container, and further wherein the plate is provided on the cover.

14. The container assembly of claim 13, wherein the plate is integrally formed with the cover.

15. The container assembly of claim 1, wherein the one-way valve is configured to move to the sealing position upon removal of the air-extracting device from the one-way valve.

16. The container assembly of claim 1, wherein the air extracting device comprises a barrel and a plunger slidably disposed in the barrel.

17. The container assembly of claim 16, wherein the barrel of the air extracting device comprises an insertion end and an opposite plunger end, wherein the insertion end is airtightly fittable over and around the one-way valve, and further wherein the plunger extends from the plunger end.

18. The container assembly of claim 17, wherein the one-way valve is provided in a recessed portion of the container, and the insertion end of the barrel is fittable into said recessed area, over and around the one-way valve.

19. A consumables container assembly comprising:

a container defining an interior space;

a one-way valve provided in the container, the one-way valve configured to selectively adopt a sealing position and an unsealing position in which the one-way valve opens or closes, respectively, one or more valve openings formed through the container;

a flexible and deformable, internal bag arranged within the interior space of the container and defining an interior space, wherein a first section of the internal bag is airtightly attached to an inner side of the container in an area encircling said one or more valve openings, and other sections of the internal bag are detachable from the container and are collapsible; and an air extracting device selectively disposable in fluid communication with the one-way valve, wherein the air extracting device is operable to apply negative pressure to the one-way valve to move the one-way valve to the unsealing position and suction air from the interior space of the internal bag via the one or more valve openings in the container; wherein the container further comprises one or more vent openings formed therethrough and providing fluid communication between an outside of the container and an area of the interior space of the container located outside the interior space of the internal bag.

20. A consumables container assembly comprising:

a container defining an interior space, the container comprising a container body and a cover, wherein the cover is selectively movable relative to the container body between a closed position and an open position, wherein, in the closed position, the cover and container body enclose the interior space of the container;

a one-way valve provided in the cover of the container, the one-way valve configured to selectively adopt a sealing position and an unsealing position in which the one-way valve opens or closes, respectively, one or more valve openings formed through the cover of the container;

a flexible and deformable, internal bag arranged within the interior space of the container and defining an interior space, wherein a first section of the internal bag is airtightly attached to an inner side of the container in an area encircling said one or more valve openings, and other sections of the internal bag are detachable from the container and are collapsible; and an air extracting device selectively disposable in fluid communication with the one-way valve, wherein the air extracting device is operable to apply negative pressure to the one-way valve to move the one-way valve to the unsealing position and suction air from the interior space of the internal bag via the one or more valve openings in the container; wherein the container further comprises one or more vent openings formed therethrough and providing fluid communication between an outside of the container and an area of the interior space of the container located outside the interior space of the internal bag; and further wherein when the cover is arranged in the open position, the cover allows access to the interior space of the internal bag housed within the interior space of the container.

* * * * *